United States Patent [19]

Mazumder et al.

[11] Patent Number: 4,673,141

[45] Date of Patent: Jun. 16, 1987

[54] FEED CONTROL APPARATUS

[75] Inventors: Ali T. Mazumder; Brian M. Fairey, both of Waterloo, Canada

[73] Assignee: NCR Corporation, Dayton, Ohio

[21] Appl. No.: 775,078

[22] Filed: Sep. 12, 1985

[51] Int. Cl.[4] ..... B65H 23/08

[52] U.S. Cl. ..... 242/75.47; 247/67.3 R

[58] Field of Search ..... 242/75.47, 75.45, 194, 242/67.3 R; 400/196, 207, 208, 208.1, 186

[56] References Cited

U.S. PATENT DOCUMENTS

| | | | |
|---|---|---|---|
| 2,248,014 | 7/1941 | Roesen | 242/75.41 |
| 2,396,492 | 3/1946 | Childers | 242/75 |
| 2,811,320 | 10/1957 | Troendle | 242/75.47 |
| 2,838,253 | 6/1958 | Jacobsen | 242/75.47 |
| 3,147,933 | 9/1964 | Grieve et al. | 242/75.47 |
| 3,288,384 | 11/1966 | Clark | 242/67.3 R X |
| 3,432,020 | 3/1969 | Caudill et al. | 197/151 |
| 3,669,376 | 6/1972 | Lucas | 242/75.45 |
| 4,013,160 | 3/1977 | Colecchi et al. | 197/151 |
| 4,279,390 | 7/1981 | Wu et al. | 242/194 X |
| 4,337,001 | 6/1982 | Cappotto | 400/208 |
| 4,373,824 | 2/1983 | Olsen | 400/208 X |
| 4,422,592 | 12/1983 | Swope | 242/75.45 |

FOREIGN PATENT DOCUMENTS

| | | |
|---|---|---|
| 1956541 | 5/1971 | Fed. Rep. of Germany . |
| 624911 | 8/1981 | Switzerland . |

OTHER PUBLICATIONS

Torrington Bearing Catalog #576, Copyright 1976, pp. 156 to 160.

*Primary Examiner*—Stuart S. Levy
*Assistant Examiner*—Katherine Matecki
*Attorney, Agent, or Firm*—Wilbert Hawk, Jr.; Albert L. Sessler, Jr.

[57] ABSTRACT

Feed control apparatus includes a rotatable supply roll on which a supply of sheet or ribbon to be dispensed may be placed, a brake for applying variable braking force to said supply roll to prevent overrunning of the sheet or ribbon from the roll due to inertial effects, a cam for controlling the brake to provide maximum braking force when the supply of sheet or ribbon on the roll is a maximum and for reducing the braking force as the supply of sheet or ribbon on the roll is reduced, cam operating mechanism driven by the rotation of the supply roll to move the cam incrementally for each revolution of the supply roll, and a reset mechanism for resetting the cam back to its initial position following each feeding operation.

20 Claims, 6 Drawing Figures

FIG. 4
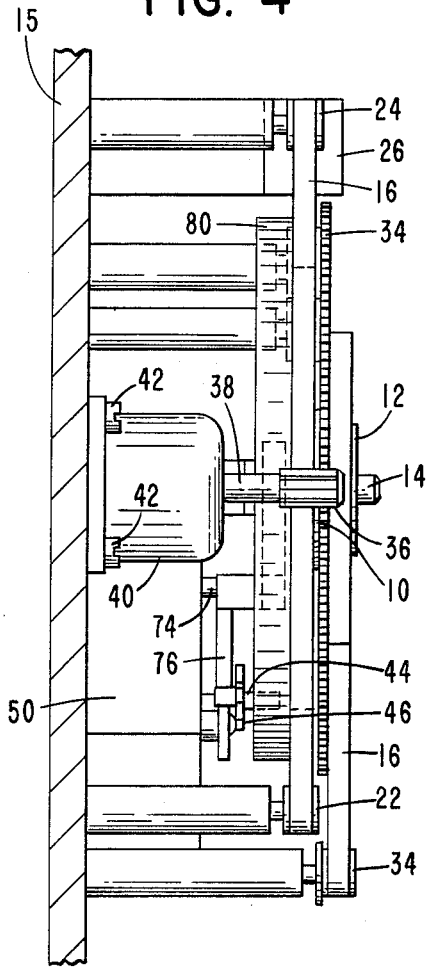
FIG. 5
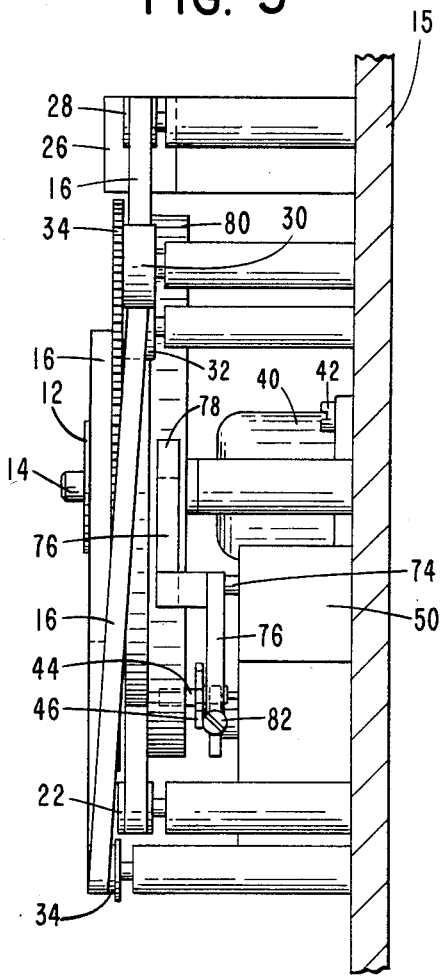
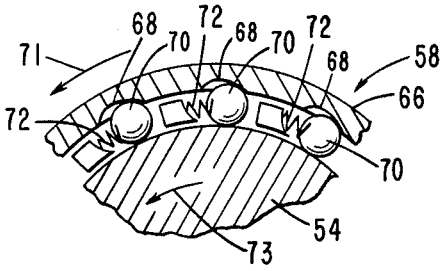
FIG. 6

FEED CONTROL APPARATUS

BACKGROUND OF THE INVENTION

This invention relates generally to feed control apparatus and more specifically relates to apparatus for minimizing the effects of inertia and mass problems in ribbon or sheet feeding devices. Such inertia and mass problems are a major source of non-uniform ribbon advance, for example, in high-speed magnetic ink character recognition (MICR) encoders, which are used in check processing systems employed by banks and other financial institutions.

Various types of braking apparatus have been employed in the past to control the speed at which ribbon or sheet material is unwound from a supply roll, and to thereby prevent overrunning of the ribbon or sheet due to the inertia of the supply roll after it has commenced moving. Optimum control of inertia effects while feeding ribbon or sheet material is thus helpful in maximizing the efficient operation of such feeding devices.

SUMMARY OF THE INVENTION

The present invention provides a feed control apparatus which employs a brake which coacts with a feed roll to control the rotational speed of the feed roll during feeding of ribbon or sheet material to thereby minimize undesirable inertial effects. For purposes of the present invention, it will be understood that the terms "ribbon" and "sheet" may be considered to be essentially interchangeable, with the difference, if any, being one of relative width. The force with which the brake coacts with the feed roll is dependent upon the number of revolutions made by the feed roll from a starting position, so that the force with which the brake coacts with the feed roll varies in accordance with the amount of material to be fed remaining on the roll.

In accordance with one embodiment of the invention, sheet feed control apparatus comprises apparatus support means; sheet supply means rotatably mounted on said apparatus support means; brake means for applying variable braking force to said sheet supply means; control means for altering the force with which said brake means is applied to said sheet feeding means; operating means driven by engagement with said sheet supply means to incrementally move said control means for each revolution of said sheet supply means for altering the force with which said brake means is applied to said sheet supply means, varying from a relatively large force when the sheet supply means contains a full sheet supply, to a relatively small force when said sheet supply has been exhausted; and reset means to reset said operating means to an initial position after said sheet supply has been exhausted, in preparation for dispensing of the next supply of sheet from said sheet means.

In accordance with a second embodiment of the invention, ribbon feed control apparatus comprises apparatus support means; ribbon supply means on which a supply of ribbon may be placed, said ribbon supply means being rotatably mounted on said apparatus support means; ribbon take-up means rotatably mounted on said apparatus support means; drive means for driving said ribbon take-up means; guide means for guiding ribbon from said ribbon supply means to said ribbon take-up means; brake means for applying variable braking force to said ribbon supply means; lever means pivotally mounted on said apparatus support means, having said brake means adjacent one end thereof and having cam following means adjacent the other end thereof; cam means rotatably mounted on said apparatus support means in operative engagement with said cam following means for causing movement of said lever means as said cam means is rotated from an initial position to a final position; cam operating means driven by engagement with said ribbon supply means to incrementally move said cam means for each complete revolution of said ribbon supply means for altering the force with which the brake means is applied to the ribbon supply means, varying from a relatively large force when the ribbon supply means contains a full supply of ribbon, to a relatively small force when said ribbon supply has been exhausted; and reset means for resetting said cam means from said final position to said initial position, after said ribbon supply has been exhausted, in preparation for replacement and dispensing of the next supply of ribbon from said ribbon supply means.

It is accordingly an object of the present invention to provide a ribbon or sheet feed control apparatus capable of minimizing undesirable inertial effects in a feed roll.

Another object is to provide a ribbon or sheet feed control apparatus including brake mechanism capable of applying a force to a feed roll which varies in accordance with the amount required to overcome undesirable inertia effects.

A further object is to provide a ribbon or sheet feed control apparatus having a brake for coacting with a feed roll, the braking force applied to the feed roll varying inversely with the number of revolutions made by said feed roll from an initial position in which said feed roll carries a full supply of ribbon or sheet material.

A further object is to provide a ribbon or sheet feed control apparatus having a cam-operated brake for coacting with a feed roll, the cam being operated in accordance with the number of revolutions made by the feed roll from an initial position, and manually operated mechanism for resetting said cam to an initial position.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 4 is a sectional view taken along line 4—4 of FIG. 1.

FIG. 5 is a sectional view taken along line 5—5 of FIG. 1.

FIG. 6 is a fragmentary sectional view showing details of the clutch employed in the cam reset mechanism.

DESCRIPTION OF THE PREFERRED EMBODIMENT

Figure 1:
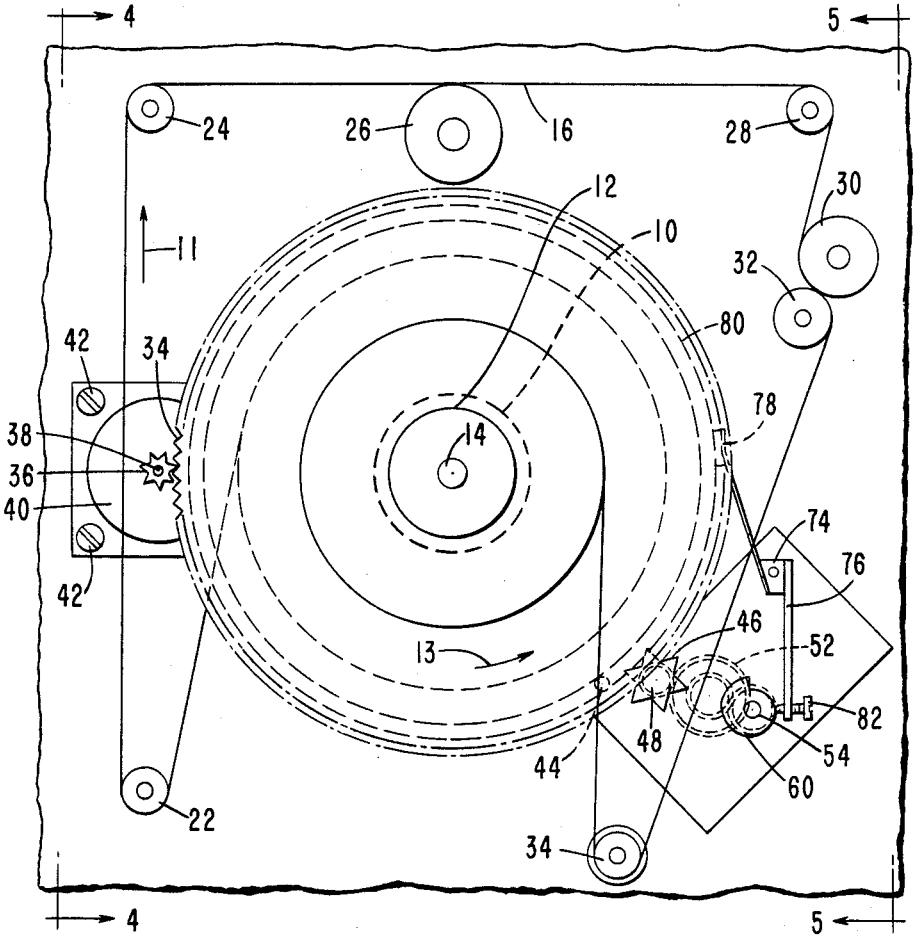
FIG. 1 is a plan view showing a ribbon supply roll, a take-up roll, a brake coacting with the supply roll, and a cam for controlling said brake.

Referring now to FIG. 1 of the drawings, a supply roll 10 and a take-up roll 12 are shown, mounted on a common shaft 14 fixed in a base 15. While the invention may be used in connection with the feeding of many different type of materials, including sheets and ribbons, the illustrated embodiment is particularly adapted for the feeding of ink ribbons in connection with printing apparatus. Ink ribbon 16 in roll form is placed for feeding on supply roll 10.

From the supply roll 10, which is rotated counterclockwise in the direction of the arrow 13, the ink ribbon 16, which moves in the direction of the arrow 11, extends around first and second guide rollers 22 and 24, past a print head 26, around a third guide roller 28, through tension rollers 30, 32 and around a fourth guide roller 34, to the take-up roll 12, where it is collected. All of the elements 22, 24, 26, 28, 30 and 32 are mounted on the base 15. The take-up roll 12 is driven by the engagement of teeth 34 on the periphery of the roll 12 with a gear 36 fixed on a shaft 38 driven by a motor 40 fixed to the base 15 by suitable fasteners, such as screws 42.

Depending from the lower surface of the ribbon-supporting disk portion of the supply roll 10, and secured to said roll, is a stud 44 which engages a gear or star wheel 46 fixed to a shaft 48 which extends upwardly from a gear box 50 fixed to the base 15. Contained within the gear box 50 and driven by the shaft 48 is a series of nested engaging gears, represented generally by gears 52, which ultimately drive a shaft 54 extending from said gear box 50. The particular numbers and sizes of gears required may be determined in a particular instance, as is well-known to one skilled in the art, in accordance with the gear ratio desired between the shaft 48 and the shaft 54. The manner in which this gear ratio is determined will be subsequently described.

A combined cam and reset mechanism, designated generally by reference character 56, is coupled by means of a clutch 58 (FIG. 6) to the upper end of the shaft 54. In the illustrated embodiment, the cam 60 is formed integrally with a knob 62 which can be used for resetting purposes. The cam 60 is configured to have an operating surface 64 which varies linearly in radial distance between a first position at which such distance is a maximum and a second position in which said distance is a minimum. The knob 62 is of a suitable configuration to be grasped and rotated by hand.

The knob and cam combined mechanism 56 is coupled to the shaft 54 by a clutch 58 of the type which causes the combined mechanism 56 to be rotated by the shaft 54, but which permits the mechanism 56 to be rotated back from its second position to its first position without causing the shaft 54 to be correspondingly rotated. Such "one-way" clutches are readily available. One suitable type is manufactured by the Torrington Company, Torrington, Conn., and is shown in fragmentary form in FIG. 6. A sleeve 66 is pressed into a corresponding cavity in the combined mechanism 56 and includes a plurality of ramped recesses 68 within each of which is received a cylindrical roller 70. The roller 70 is urged toward the shallow end of the ramped recess 68 by a spring 72 which may be integral with the sleeve 66. It will be seen that when the knob 62 is rotated in a counterclockwise direction, as viewed in FIG. 6, the rollers 70 are urged to the right into the shallow end of the ramped recesses 68, and therefore jam between the sleeve 66 and the shaft 54, so that both the knob 62 and the shaft 54 move together, as indicated by the arrows 71 and 73. On the other hand, when the shaft 54 is rotated in a counterclockwise direction, or the knob 62 is rotated in a clockwise direction, as viewed in FIG. 6, the rollers 70 are urged to the left into the deeper ends of the rampled recesses 68. Due to the greater depth at this end of the recesses 68, the rollers do not jam between the sleeve 66 and the shaft 54, and the two will rotate independently of each other.

A stud 74 mounted on the gear box 50 serves as a pivot for a lever arm 76 having at one end thereof a brake 78 which engages the peripheral surface 80 of the supply roll 10. At the other end of the lever arm 76 is a cam follower 82, which may take the form of a screw positioned within a threaded aperture 84 of the level arm 76. The lever arm 76 is of resilient material, such as spring steel, for example. Adjustment of the cam follower 82 within the aperture 84 can therefore alter the force applied by the brake 78 against the peripheral surface 80 for a given position of the cam 60.

Figure 2:
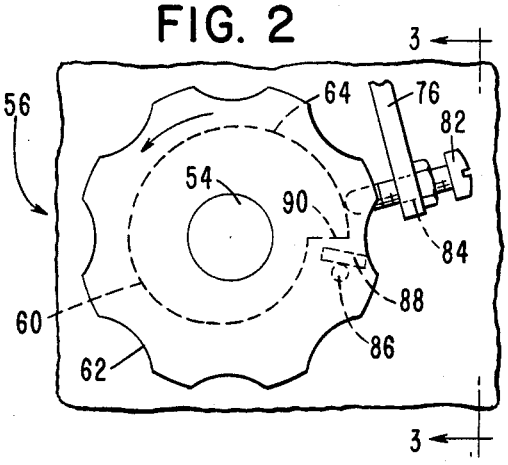
FIG. 2 is a fragmentary plan view showing a reset knob for resetting the brake control cam.
Figure 3:
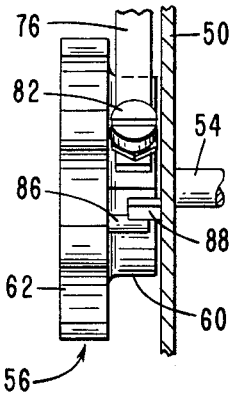
FIG. 3 is a sectional view taken along line 3—3 of FIG. 2.

It will be seen that when the cam 60 is in the position shown in FIG. 2, with respect to the cam follower 82, a maximum force is applied by the brake 78 against the surface 80. It will also be noted that a stud 86 depending from the knob 62 engages a stop 88 fixed to the housing of the gear box 50 to prevent further movement of the cam 60 and knob 62 during a resetting movement. As the cam 60 rotates in a counterclockwise direction in response to movement of the supply roll 10, the radial distance from the center of the cam 60 of that portion of the surface 64 engaged by the follower 82 decreases in a linear manner, thereby lessening the force applied by the brake 78 against the peripheral surface 80 of the supply roll 10. This is in accordance with the lesser amount of ink ribbon 16 remaining on the supply roll 10, and the consequent lower inertia which must be controlled.

When the cam 60 has rotated to a position in which the surface 64 is closest to the cam center, the ink ribbon supply on the supply roll 10 has been substantially exhausted. A new ink ribbon supply is then placed on the roll 10, and the combined mechanism 56 is then rotated in a counterclockwise direction in a resetting movement until the stud 86 engages the stop 88. The feed control apparatus is now ready for another feeding operation.

The effective ratio desired between one revolution of the supply roll 10 and one revolution of the cam 60 may be determined as follows. It is desired to produce essentially one full revolution of the cam 60 during the time that a full supply of ink ribbon 16 on the supply roll 10 is dispensed. The number of revolutions of the supply roll 10 required to accomplish this may be calculated by dividing the radial width of the roll of ribbon 16 by the thickness of the ribbon. Thus, for example, if the radial width of the roll of ribbon is 2.4 inches and the thickness of the ribbon is 0.00052 inch, 4615 revolutions of the supply roll 10 will be required to dispense all of the ribbon from the roll. If the various gears, including the star wheel 46 and the gears in the gear box 50, are chosen to give, for example, an overall ratio of 5160 to one, then it will be seen that a safety margin of 38 degrees is provided for overall rotation of the cam. This is established by dividing 4615 by 5160 and multiplying by 360, which gives a result of 322. This quantity subtracted from 360 degrees gives 38 degrees, which is an adequate safety margin to prevent the cam follower 82 from engaging the notch 90 in the cam surface 64.

While the form of the invention shown and described herein is admirably adapted to fulfill the objects primarily stated, it is to be understood that it is not intended to confine the invention to the form or embodiment disclosed herein for it is susceptible of embodiment in various other forms within the scope of the appended claims.

What is claimed is:

1. Ribbon feed control apparatus comprising:
apparatus support means;
ribbon supply means on which a supply of ribbon may be placed, said ribbon supply means being rotatably mounted on said apparatus support means;
ribbon take-up means rotatably mounted on said apparatus support means;
drive means for driving said ribbon take-up means;
guide means for guiding ribbon from said ribbon supply means to said ribbon take-up means;
brake means for applying variable braking force to said ribbon supply means;
lever means pivotally mounted on said apparatus support means, having said brake means adjacent one end thereof and having cam following means adjacent the other end thereof;
cam means rotatably mounted on said apparatus support means in operative engagement with said cam following means for causing movement of said lever means as said cam means is rotated from an initial position to a final position;
cam operating means driven by engagement with said ribbon supply means to incrementally move said cam means for each complete revolution of said ribbon supply means for altering the force with which the brake means is applied to the ribbon supply means, varying from a relatively large force when the ribbon supply means contains a full supply of ribbon, to a relatively small force when said ribbon supply has been exhausted; and
reset means for resetting said cam means from said final position to said initial position, after said ribbon supply has been exhausted, in preparation for replacement and dispensing of the next supply of ribbon from said ribbon supply means.

2. The ribbon feed control apparatus of claim 1 in which said cam operating means comprises a gear mechanism.

3. The ribbon feed control apparatus of claim 2 in which said gear mechanism comprises a plurality of cooperating gears.

4. The ribbon feed control apparatus of claim 2 in which the gear mechanism provides a ratio of revolutions between the ribbon supply means and the cam means approximately equal to the radial width of a full supply of ribbon contained on the ribbon supply means divided by the thickness of the ribbon.

5. The ribbon feed control apparatus of claim 1 in which said reset means comprises a manually-operated mechanism.

6. The ribbon feed control apparatus of claim 5 in which said manually-operated mechanism comprises a knob.

7. The ribbon feed control apparatus of claim 6 in which said knob is integral with said cam means.

8. The ribbon feed control apparatus of claim 7 in which a stop on said knob cooperates with a stop on said apparatus support means to limit reset movement of said knob.

9. The ribbon feed control apparatus of claim 7, in which the reset means includes clutch means operatively coupling said knob and said cam operating means.

10. The ribbon feed control apparatus of claim 1 in which said cam means comprises a cam having a cam surface representing a series of radii from its center of rotation of constantly decreasing length from said initial position to said final position.

11. The ribbon feed control apparatus of claim 1 in which the brake means coacts with a circumferential portion of said ribbon supply means.

12. The ribbon feed control apparatus of claim 1 in which the cam operating means is driven by an element located near the circumference of the ribbon supply means.

13. The ribbon feed control apparatus of claim 1 in which the cam operating means comprises a plurality of cooperating gears, and in which a stud located near the circumference of the ribbon supply means engages one of said gears for driving of the cam operating means.

14. Sheet feed control apparatus comprising:
apparatus support means;
sheet supply means rotatably mounted on said apparatus support means;
brake means for applying variable braking force to said sheet supply means;
control means for altering the force with which said brake means is applied to said sheet feeding means;
operating means driven by engagement with said sheet supply means to incrementally move said control means for each revolution of said sheet supply means for altering the force with which said brake means is applied to said sheet supply means, varying from a relatively large force when the sheet supply means contains a full sheet supply, to a relatively small force when said sheet supply has been exhausted; and
reset means to reset said operating means to an initial position after said sheet supply has been exhausted, in preparation for dispensing of the next supply of sheet from said sheet means.

15. The sheet feed control apparatus of claim 14 in which said reset means comprises a manually-operated mechanism.

16. The sheet feed control apparatus of claim 14 in which said reset means includes clutch means operatively coupling said reset means and said operating means.

17. The sheet feed control apparatus of claim 16, in which said manually-operated mechanism comprises a knob.

18. The sheet feed control apparatus of claim 17, in which a stop on said knob cooperates with a stop on said apparatus support means to limit reset movement of said knob.

19. Sheet feed control apparatus comprising:
apparatus support means;
sheet supply means rotatably mounted on said apparatus support means;
brake means for applying variable braking force to said sheet supply means;
control means for altering the force with which said brake means is applied to said sheet feeding means; and
operating means driven by engagement with said sheet supply means to incrementally move said control means for each revolution of said sheet supply means for altering the force with which said brake means is applied to said sheet supply means, varying from a relatively large force when the sheet supply means contains a full sheet supply, to a relatively small force when said sheet supply has been exhausted, said operating means including a plurality of cooperating gears, and said sheet supply means including a stud located near the circumference of said sheet supply means for engaging one of said cooperating gears to drive said operating means.

20. The sheet feed control apparatus of claim 19 in which said operating means includes rotatable cam means, and in which said plurality of cooperating gears provides a ratio of revolutions between the sheet supply means and the cam means approximately equal to the radial width of a full sheet supply contained on the sheet supply means divided by the thickness of the sheet.

* * * * *